US006062977A

United States Patent [19]

Hague

[11] Patent Number: 6,062,977

[45] Date of Patent: May 16, 2000

[54] SOURCE CAPTURE AIR FILTERING DEVICE

[75] Inventor: Stephen W. Hague, Cohasset, Mass.

[73] Assignee: Medical Air Products Group, Inc., Bridgewater, Mass.

[21] Appl. No.: 08/688,620

[22] Filed: Jul. 30, 1996

Related U.S. Application Data

[63] Continuation of application No. 08/213,606, Mar. 15, 1994, abandoned.

[51] Int. Cl.[7] ..... B08B 15/00

[52] U.S. Cl. ..... 454/341; 55/279; 55/467

[58] Field of Search ..... 55/279, 467, 471; 454/49, 67, 197, 230, 234, 341

[56] References Cited

U.S. PATENT DOCUMENTS

| | | | |
|---|---|---|---|
| 2,621,755 | 12/1952 | Gray, Jr. | 55/467 X |
| 3,768,970 | 10/1973 | Malmin | 55/279 X |
| 4,210,429 | 7/1980 | Goldstein | 55/279 |
| 4,666,478 | 5/1987 | Boissinot et al. | 55/279 |
| 4,750,917 | 6/1988 | Fujii | 55/279 X |
| 4,786,295 | 11/1988 | Newman et al. | 55/213 |
| 4,810,269 | 3/1989 | Stackhouse et al. | 55/267 |
| 4,917,862 | 4/1990 | Kraw et al. | 55/279 X |
| 4,955,997 | 9/1990 | Robertson, III | 454/230 |
| 4,987,894 | 1/1991 | Kight | 454/49 X |
| 4,990,313 | 2/1991 | Pacosz | 55/279 X |
| 5,009,869 | 4/1991 | Weinberg et al. | 423/210 |
| 5,053,065 | 10/1991 | Garay et al. | 55/385.2 X |
| 5,074,894 | 12/1991 | Nelson | 55/385.2 X |
| 5,083,558 | 1/1992 | Thomas et al. | 55/385.2 |
| 5,133,788 | 7/1992 | Backus | 55/467 |
| 5,141,540 | 8/1992 | Helmus | 55/385.2 X |
| 5,152,814 | 10/1992 | Nelson | 55/385.2 X |
| 5,160,517 | 11/1992 | Hicks et al. | 55/385.1 |
| 5,165,395 | 11/1992 | Ricci | 55/279 X |
| 5,167,681 | 12/1992 | O'Keefe et al. | 55/385.2 |
| 5,225,167 | 7/1993 | Wetzel | 55/279 X |

FOREIGN PATENT DOCUMENTS

| | | | |
|---|---|---|---|
| 1110061 | 2/1956 | France | 454/341 |
| 2615884 | 10/1977 | Germany | 454/341 |
| 2-251216 | 10/1990 | Japan | 55/471 |
| 14890 | of 1891 | United Kingdom | 454/341 |

*Primary Examiner*—Harold Joyce
*Attorney, Agent, or Firm*—Burns, Doane, Swecker & Mathis, L.L.P.

[57] ABSTRACT

An air cleaning device for reducing the nosocomial and airborne transmission of diseases, such as tuberculosis, pertussis, influenza and measles. The device is positioned at the wall behind a hospital bed and allows for the removal of localized room air at the patient's bed and creates an envelope of constantly moving air past the patient into the inlet of the device. The air currents that are so generated capture airborne particles, e.g., as droplet nuclei, arising from the patient before they are allowed to disperse throughout the room so as to reduce the possibility of exposure of patient generated ariborne pathogens to healthcare workers or others. The air source capture velocity profile is such as to provide a negative pressure at the inlet thereto and a negative pressure within the room and the captured air can be both appropriately irradiated and filtered to purify the air stream which exits from the device. The device may be mounted separately from a hospital light positioned behind the patient's bed or it may incorporate a such a hospital light into its design to allow for an optimum location of the air intake of the contaminated air emitted by a patient.

6 Claims, 3 Drawing Sheets

SOURCE CAPTURE AIR FILTERING DEVICE

Figure 1:
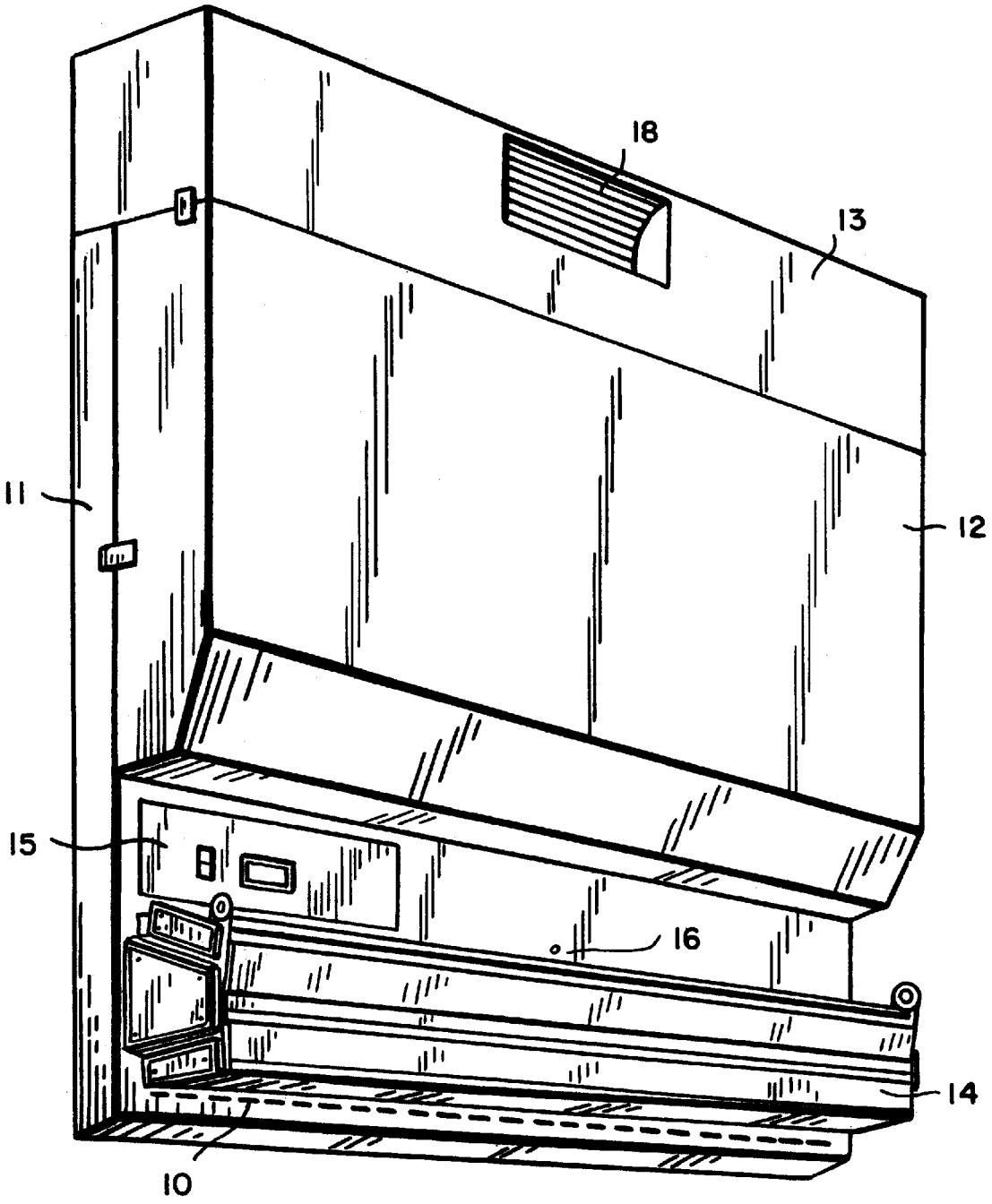

This is a continuation of application Ser. No. 08/213,606 filed on Mar. 15, 1994 abandoned.

INTRODUCTION

This invention relates generally to the field of medical/healthcare room technology and, more particularly, to air flow control and biological filtering systems for use in controlling the dispersion of pollutants in a room.

BACKGROUND OF THE INVENTION

Respiratory diseases, such as, tuberculosis, are of critical concern to hospitals or long term care medical facilities, particularly as it may adversely affect medical personnel therein. Since existing medical facilities are often not well equipped for isolating patients with infectious respiratory diseases, the risk to the healthcare worker and others because of the presence of pathogens in the air is very high. The Centers for Disease Control (CDC) in Atlanta, Ga. has proposed guidelines, e.g., published as *Guidelines for Preventing the Transmission of Tuberculosis in Health-Care Facilities,* 1993, Second Edition, for medical facilities, for emergency rooms, isolation rooms, etc. Such guidelines, however, address only the dilution of air in an entire room after the pathogens have already mixed with the existing room and hospital air. Even under such guidelines, health care workers are still at relatively high risk of exposure to the airborne pathogens.

Various portable patient isolation rooms and air filtering systems have been developed for either isolating patients or filtering the overall room air. For example, U.S. Pat. No. 5,074,894 issued on Dec. 24, 1991 to T. P. Nelson describes an enclosure which can be assembled to entirely enclose a patient within an ordinary hospital room. However, such enclosures are bulky, expensive and require some skill to assemble and, hence, are not of great practical use.

Moreover, other systems designed to withdraw patient generated contaminants from a room utilize one or more air inlets positioned at one or more locations generally remote from the patient or patients in the room so that such air throughout the entire room is withdrawn and air localized at a particular patient can not be captured before it is by health-care personnel who are present in the room.

Further, the proposed Centers for Disease Control Guidelines specifically state: "Source control techniques can prevent or reduce the spread of infectious droplet nuclei into the general air circulation. These techniques are called source control methods because they entrap infectious droplet nuclei as they are emitted by the patient, or source . . . Local exhaust is the preferred ventilation technique. Because local ventilation captures airborne contaminants very near their source, before they can disperse, it is often the most efficient way to contain contaminants." Thus, it is desirable to prevent the general dispersion into a room or other enclosed space of patient generated airborne pathogens, such as tuberculosis, when the patient is laying or sitting on his or her hospital bed. However, no effective source control techniques are currently available to the art.

BRIEF SUMMARY OF THE INVENTION

In accordance with the invention, effective filtering/ventilation devices are provided at localized spatial zones or regions, each of which is substantially at each patient's bed.

Each device is designed to provide an airflow great enough to create a negative pressure at the inlet to the device with respect to the localized region at the patient's bed. In addition, it creates a negative pressure within the room relative to the exterior of the room. The purpose of such a negative pressure at the inlet is to prevent airborne contaminants from escaping into the room from the patient's bed and thus contaminating adjacent areas of the room. The negative pressure in the room prevents contaminants from escaping to the exterior of the room. In order for air to flow from one area to another, there must be a difference in air pressure between the two areas, air flowing from a higher pressure to a lower pressure area i.e. the lower pressure area at the inlet has a "negative pressure" relative to the localized external higher pressure area. The level of negative pressure achieved is a function of the design of the room and the ventilation system involved. For example, a pressure differential of negative 0.001 inch of water within the room and an inward air velocity of 100 feet per minute (fpm) are minimum CDC acceptable levels for isolation rooms in hospitals. The system of the invention is effectively designed to provide both contaminant source capture and negative pressure.

Monitoring or periodic checks are required to assure that these negative pressure guidelines are being met. In the event that the room pressure rises above these negative pressure requirements, the ventilation system should be such that it will increase the amount of exhausted air to attempt to maintain the appropriate inward air velocity and room pressure to prevent airborne contaminants from leaving the localized space.

DESCRIPTION OF THE INVENTION

Figure 2:
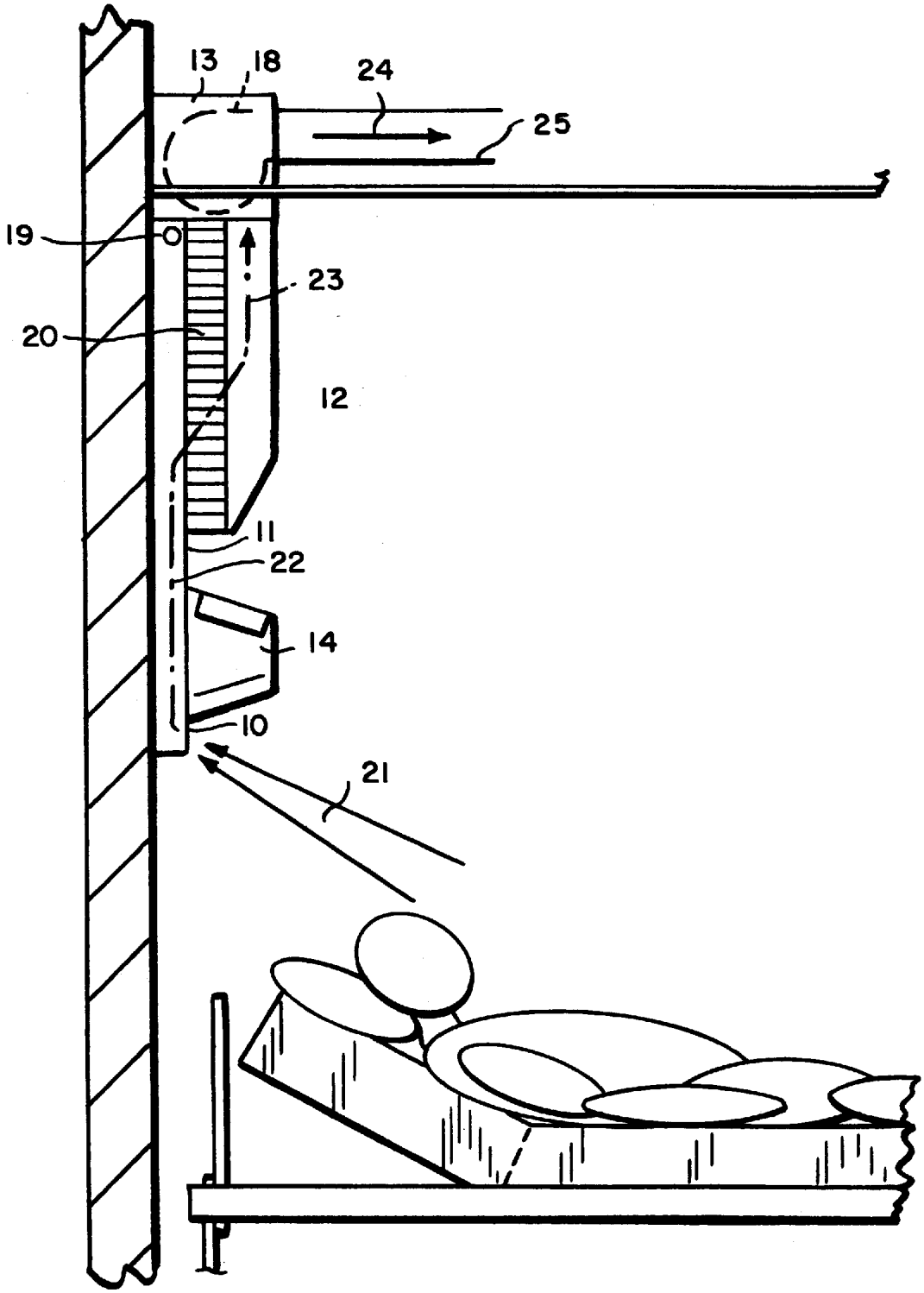
Figure 3:
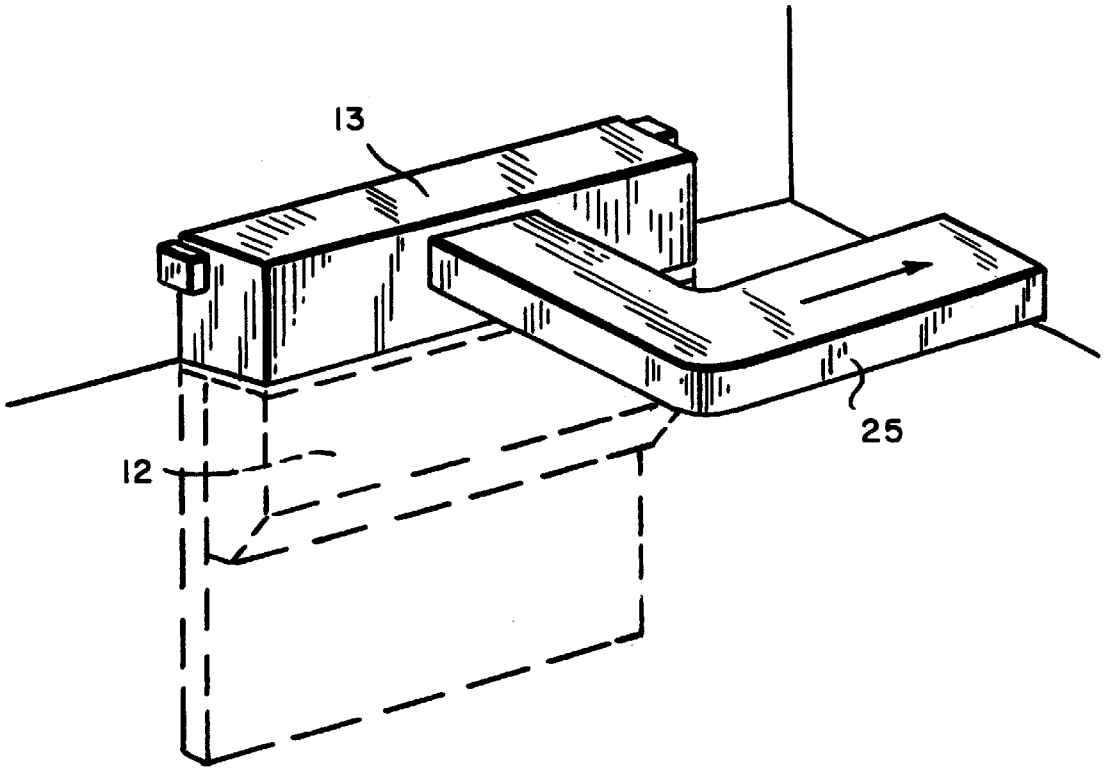

The invention can be understood more readily from the following more detailed description of the invention together with the accompanying drawings, wherein FIG. 1 shows a perspective view of an exemplary embodiment of an air purification device of the invention in which the components are housed in a wall mounted housing;

FIG. 2 shows a view in section of the device shown in FIG. 1 as positioned with respect to a patient in a hospital bed; and FIG. 3 shows another perspective view of a portion of the system of FIG. 1 depicting the discharge of purified air through a duct system.

FIGS. 1 and 2 depict a source capture air purification device having a specific design configuration and components according to a preferred embodiment of the invention. The device is designed to have a relatively narrow profile and to fit directly at the wall in the space behind the head of a hospital bed. The device comprises an air inlet 10 designed and located to provide efficient capturing of contaminants, e.g., infectious droplet nuclei. Preferably, the device is mounted at the wall so that the air inlet 10 is between about one to three feet above the bed.

The device includes a housing which comprises a rear chamber 11 which houses an ultraviolet (UV) lamp 19 and a removable front chamber 12 which provides access to a filter 20. A flow path 22 is provided from air inlet 10 to filter 20 and a flow path 23 is provided within chamber 12 for the flow of clean air from the filter 20 to a blower chamber 13 in which is mounted a double inlet centrifugal blower 18. The blower 18 provides the required airflow outwardly from chamber 13 and operates against the resistance of the filter, external ductwork and internal flow channels.

The unit is controlled via a control panel 15, which includes a means for activating the power to the system, a means to change blower speeds and includes system monitoring elements for providing a visual indication, for example, of system status and hours of operation, as would be well known to those in the art. In a particular embodiment of the system, a test port 16 is provided which allows for periodic checking of airflow through the unit.

Although the device can be designed as a unit which is separate from a patient light unit also positioned at the wall, in the specific overall embodiment shown, a hospital patient light 14 can be incorporated in to the unit to provide light to the patient and to assist in providing a desired capture velocity profile of the unit. For example, the light unit is positioned usually at a height less than six feet off the floor, averaging about 60 inches in many environments, and is generally three to four feet in length.

As will be described in more detail below, contaminated air containing droplet nuclei and other airborne particles, are captured in the localized room air which is being directed toward the inlet opening 10. As the air gets closer to the opening, its velocity increases thereby effectively permitting the system to capture additional airborne contaminants. Preferably, the approximate velocity of air at inlet 10, for example, can be set at about 300 fpm for low speed operation of the unit and at about 550 fpm for high speed operation. Such velocity results in the creation of an appropriate source capture zone and also provides enough airflow to create a negative pressure within a typical hospital room of less than negative 0.001 inches of water.

As can be seen in FIG. 2, air 21 enters rear chamber 11 and is directed upwardly through chamber 11. The inlet air is then irradiated by a germicidal UV lamp 19 positioned at or near the top of the chamber, using a UV lamp such as available from Sylvania/GTE Corporation of Danvers, Mass. under the model designation SYLG30T8. The air is then filtered by a high efficiency particulate arrestor (HEPA) filter 20, such as available from American Air Filter Co. of Louisville, Kentucky under the model designation ASTROCEL II. The location of the UV lamp above the air flow path at or near the top of chamber 11 is critical in that its location allows for both the irradiation of the incoming contaminated air 22 in the chamber 11 and of the front or inlet surface of filter 20 where the highest concentration of contaminating microorganisms would be captured. In addition, because the UV lamp 19 is offset from the airstream itself it is not directly in contact with the contaminated air 22 in the chamber. This location also prevents the buildup of dust on the surface of the UV lamp which would eventually degrade the performance of the lamp.

When the purified air in flow path 23 has passed through the filter 20, it has been both irradiated by UV light and filtered by filter 20. The air 23 then enters the blower chamber 13 and, via the operation of a blower 18, such as is available from EBM, Co. of Farmington, Conn. under the model designation D2E133, is discharged as a clean airstream 24 into a duct 25. The discharged air in the embodiments shown can be ducted via duct 25 (FIG. 3) to a location outside the room, for example, the blower 18 creating the above negative pressure environments.

The exhausted clean air 24 may be circulated to other rooms or areas of the facility, exhausted to locations outside the facility, or recirculated back into the same room. HEPA filters, or even more efficient filters, e.g., an ultra-particulate arrestor (ULPA) filter, also available from American Air Filter Co., may be used to reduce or eliminate infectious droplet nuclei from the room air.

While the particular embodiments described above represent preferred embodiments of the invention, modifications thereto may occur to those in the art within the spirit and scope of the invention. Hence, the invention is not to be construed as limited to such embodiments, except as defined by the appended claims.

What is claimed is:

1. An air flow control and biological filtering system for use in controlling the dispersion of pollutants in a room comprising:

a rear chamber having a top end, a bottom end, and a front surface having an outlet; said rear chamber being mounted on a wall and having an inlet positioned at said bottom end;

a blower chamber having a bottom, an inlet on said bottom, and an outlet, said blower chamber being mounted on a wall with said bottom abutting said top end of said rear chamber and extending upwardly past a ceiling of the room, the blower chamber accommodating a blower for creating a negative air pressure at said inlet;

a front chamber detachably mounted to said front surface of said rear chamber and having an outlet at an upper end thereof connected to said inlet of said blower chamber; wherein the front chamber is in fluid communication with the outlet of the rear chamber, the negative pressure created by the blower creating an air flow from the inlet of the rear chamber, through the outlet of the rear chamber and through the front chamber; and thereafter through the inlet of the blower chamber to the outlet of the blower chamber.

2. The air flow control and biological filtering system of claim 1, further comprising a filter within said front chamber completely covering said outlet of said rear chamber, such that all air passing from said rear chamber to the front chamber is filtered.

3. The air flow control and biological filtering system of claim 2 wherein the filter is an HEPA filter.

4. The air flow control and biological filtering system of claim 2 wherein the filter is an ULPA filter.

5. The air flow control and biological filtering system of claim 2, further comprising a UV germicidal lamp located at said upper end of said rear chamber; wherein said lamp illuminates the air flow through the inlet of said rear chamber and the filter covering the outlet of the rear chamber.

6. The air flow control and biological filtering system of claim 1, further comprising a duct member attached to the outlet of the blower chamber for conducting filtered air.

* * * * *